United States Patent [19]

Griffin et al.

[11] Patent Number: 4,509,335

[45] Date of Patent: Apr. 9, 1985

[54] PRE-ASSEMBLED COOLING AND AIR CIRCULATING MODULE FOR A HOUSEHOLD REFRIGERATOR

[75] Inventors: James R. Griffin; James A. White, both of Louisville, Ky.

[73] Assignee: General Electric Company, Louisville, Ky.

[21] Appl. No.: 624,201

[22] Filed: Jun. 25, 1984

[51] Int. Cl.[3] ..... F25B 45/00

[52] U.S. Cl. ..... 62/77; 62/298; 62/441; 62/443; 62/448

[58] Field of Search ..... 62/441, 443, 448, 77, 62/298

[56] References Cited

U.S. PATENT DOCUMENTS

| | | | |
|---|---|---|---|
| 2,257,374 | 9/1941 | Fritz | 62/116 |
| 2,462,115 | 2/1949 | Luecke | 62/116 |
| 2,685,178 | 8/1954 | Eck | 62/115 |
| 3,116,614 | 1/1964 | King | 62/283 |
| 3,116,615 | 1/1964 | Harle | 62/283 |
| 3,225,563 | 12/1965 | Braun | 62/277 |
| 3,252,292 | 5/1966 | O'Connell et al. | 62/77 |
| 3,261,173 | 7/1966 | Gould | 62/298 X |
| 3,433,031 | 3/1969 | Scheitlin et al. | 62/448 |
| 3,712,078 | 1/1973 | Maynard et al. | 62/448 |
| 3,736,768 | 6/1973 | Harbour et al. | 62/455 |
| 3,766,976 | 10/1973 | Gelbard et al. | 165/122 |
| 3,785,168 | 1/1974 | Domingorene | 62/455 |
| 4,023,380 | 5/1977 | Drouin | 62/279 |
| 4,077,229 | 3/1978 | Gelbard et al. | 62/283 |

*Primary Examiner*—Lloyd L. King

*Attorney, Agent, or Firm*—Frank P. Giacalone; Radford M. Reams

[57] ABSTRACT

A refrigerator including two compartments, one of which is maintained at a temperature above freezing and the other of which is maintained at a below freezing temperature. The refrigerator cabinet is divided into the two compartments by a divider that is slidably received in support grooves in the side walls of the cabinet. A self-contained pre-assembled air circulating and cooling module is arranged on the rear wall of the cabinet and the divider installed so that air circulated through the pre-assembled module is proportionally divided between the compartments in amounts sufficient to maintain the compartments at the preselected temperature.

3 Claims, 5 Drawing Figures

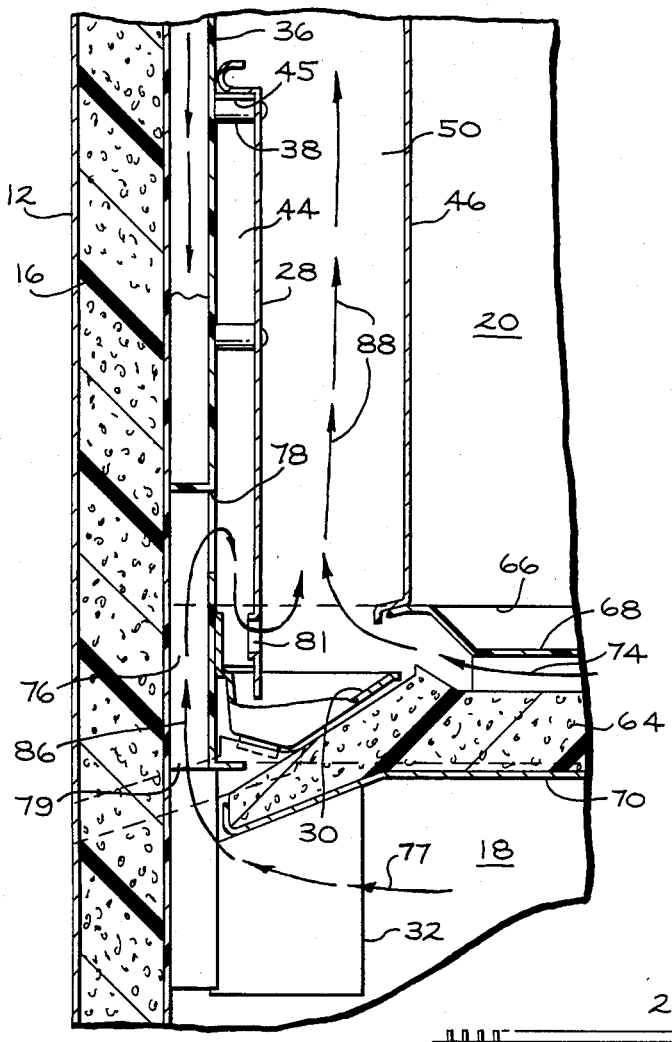
FIG.3
FIG.4
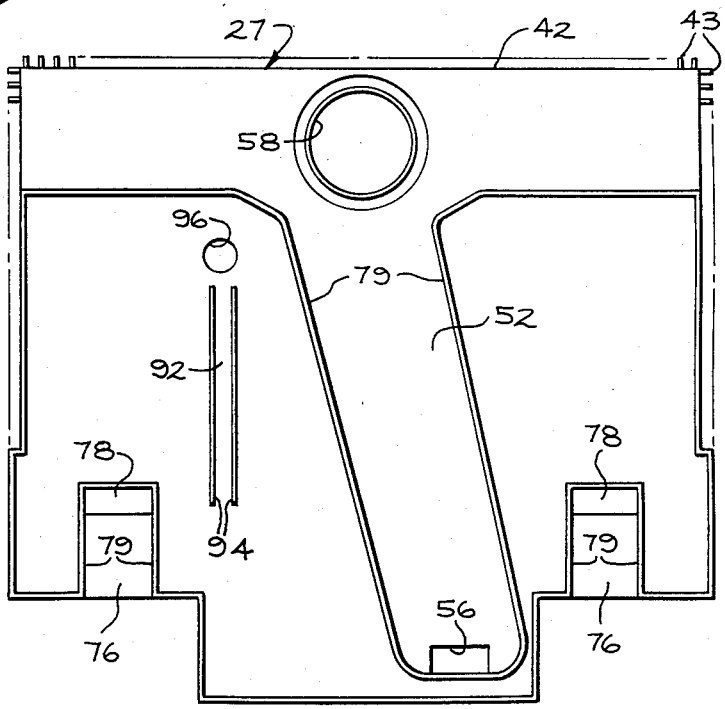

26
42
36
43
48
22
27
40
58
43
48
45
38
46
78
45
79
79
52
40
38
78
24
81
30
76
79
56
32
28
34

PRE-ASSEMBLED COOLING AND AIR CIRCULATING MODULE FOR A HOUSEHOLD REFRIGERATOR

BACKGROUND OF THE INVENTION

This invention relates to household refrigerators of the type in which an above freezing and a below freezing storage compartments are cooled by an evaporator positioned in a self-contained module and more particularly to the method of pre-assembling a cooling and air circulating module which is adapted to cool both compartments by circulating air in a predetermined ratio between compartments.

In some prior art refrigerators, such as disclosed in U.S. Pat. No. 4,077,299-Gelbard assigned to the General Electric Company, the assignee of the present invention, a refrigerator is provided including two compartments, one of which is maintained at a temperature above freezing for storage of fresh foods and the other of which is maintained at a temperature below freezing for storage of frozen foods is cooled by air circulated over an evaporator disposed outside the compartments. The evaporator comprises a metal plate having a cooling element mounted thereon in heat exchange relationship. The evaporator is positioned in the cabinet in such a manner that the cooling element is disposed in a first passage and air is circulated over the cooling element and then in proportioned amounts to the aforementioned compartments. To reduce the amount of frost collected on the cooling element, a second passage is provided in the refrigerator cabinet adjacent the opposite side of the plate from that on which the cooling element is mounted. Moist air returning from the fresh food compartment is caused to circulate through this second passage in contact with the aforementioned plate so that a substantial amount of moisture in this air deposits on the plate as frost before the air reaches the first passage and the cooling element. The plate is spaced from the rear inner wall of the refrigerator to form the second passage between the plate and the inner wall of the refrigerator. The warm air circulating through the second passage which is disposed adjacent a substantial portion of the rear inner wall of the refrigerator reduces heat leakage from the exterior of the refrigerator to the interior of the refrigerator.

In accordance with the present invention, a construction is provided wherein the cooling or low side portion of the refrigeration system, including the cooling element and air circulating means for supplying cooled air to separate compartments of the refrigerator, are incorporated in a pre-assembled module which is adapted to be located in the refrigerator cabinet.

SUMMARY OF THE INVENTION

In carrying out the objects of this invention, in one form thereof, a self-contained pre-assembled air circulating and cooling module is fabricated and arranged in a refrigerator cabinet. The cabinet includes guide means dimensioned for receiving a partition means which divides the refrigerator cabinet between a first food storage compartment to be maintained at a temperature above freezing and a second food storage compartment to be maintained at a below freezing temperature. The module is pre-assembled and the operative pre-assembled air circulating and cooling module is then installed in the cabinet. A main support frame is provided which is dimensioned to extend substantially the full width of the cabinet in the second food storage compartment. Mounted on the main support frame is a plate arranged in spaced relationship to the main support frame to define a first passageway therebetween. A cover portion is mounted on the support frame in spaced relationship to the plate defining a second passageway including an evaporator. An air moving means is arranged on the support frame for moving air through the passageways.

The pre-assembled module as thus described is installed in the cabinet in spaced relationship to the rear wall of the cabinet so that a third passageway is arranged between the support frame and the cabinet wall. In the final step of assembly the partition means is arranged in the cabinet guide means to thereby divide the cabinet between the first and second food storage compartments; whereby the air moving means directs air from the first compartment to the first passageway and thereafter to the second passageway and then through the third passageway back to the first compartment, and for directing air from the second compartment to the second passageway and thereafter back to the second compartment.

DESCRIPTION OF THE DRAWINGS

FIG. 3 is an elevation view taken along line 3—3 of FIG. 2 showing certain details of the invention;

FIG. 4 is an elevational view of the module taken along line 5—5 of FIG. 1.

DESCRIPTION OF THE PREFERRED EMBODIMENT

Figure 1:
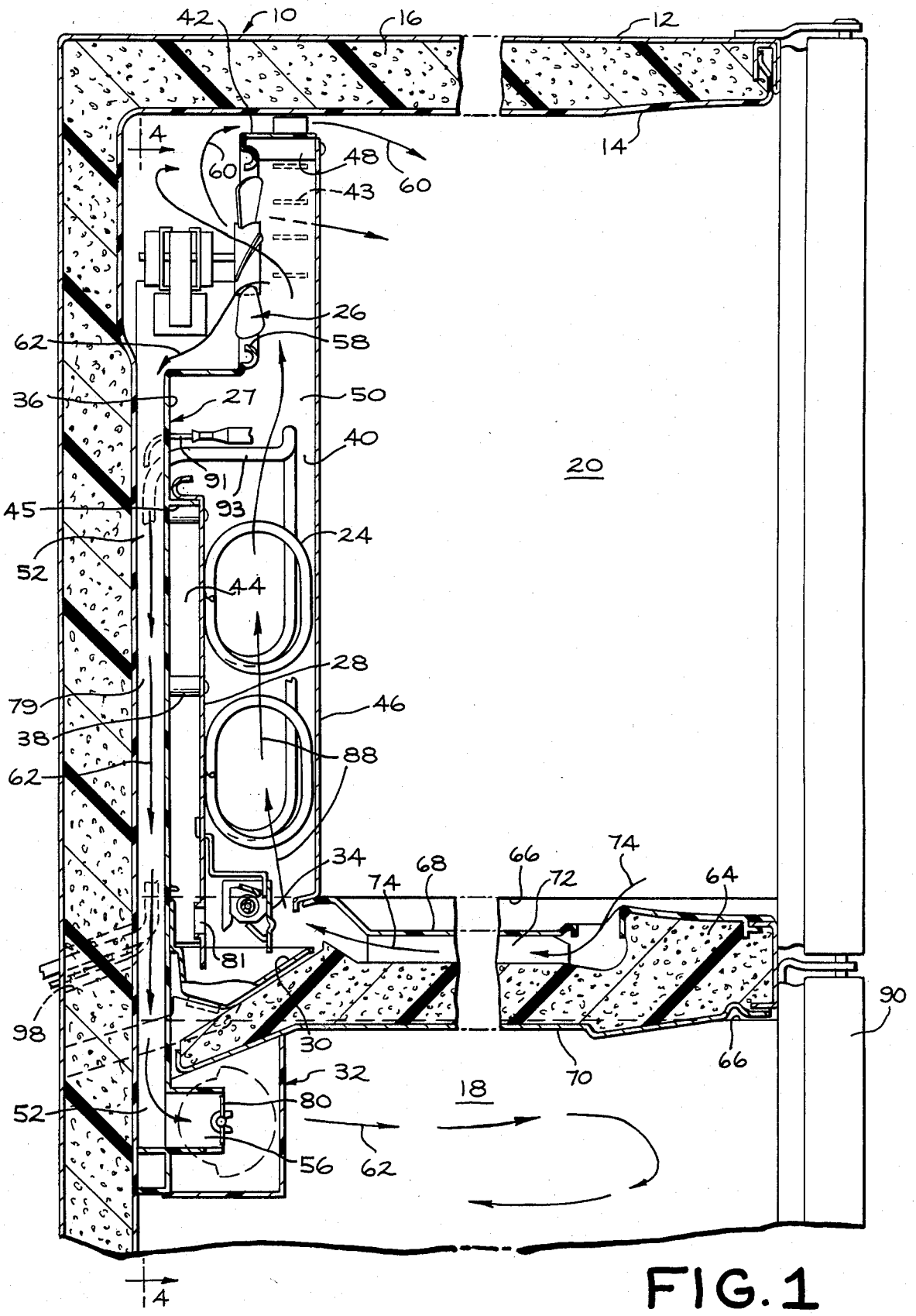
FIG. 1 is a sectional side elevation view, partly broken away, of a portion of a refrigerator cabinet incorporating the pre-assembled module of the present invention.

Referring now to the drawings there is shown a refrigerator cabinet 10 which includes an outer wall 12 and an inner wall 14 spaced from the outer wall. The space between the outer and inner walls is filled with terminal insulation 16 in a conventional manner.

Formed within the interior of the refrigerator cabinet are a first compartment 18 positioned in the bottom portion of the cabinet and a second compartment 20 positioned in the top portion of the cabinet. The compartment 18 is to be maintained at a temperature above freezing for the storage of fresh food and the compartment 20 is to be maintained at a temperature below freezing for the storage of frozen foods.

Figure 5:
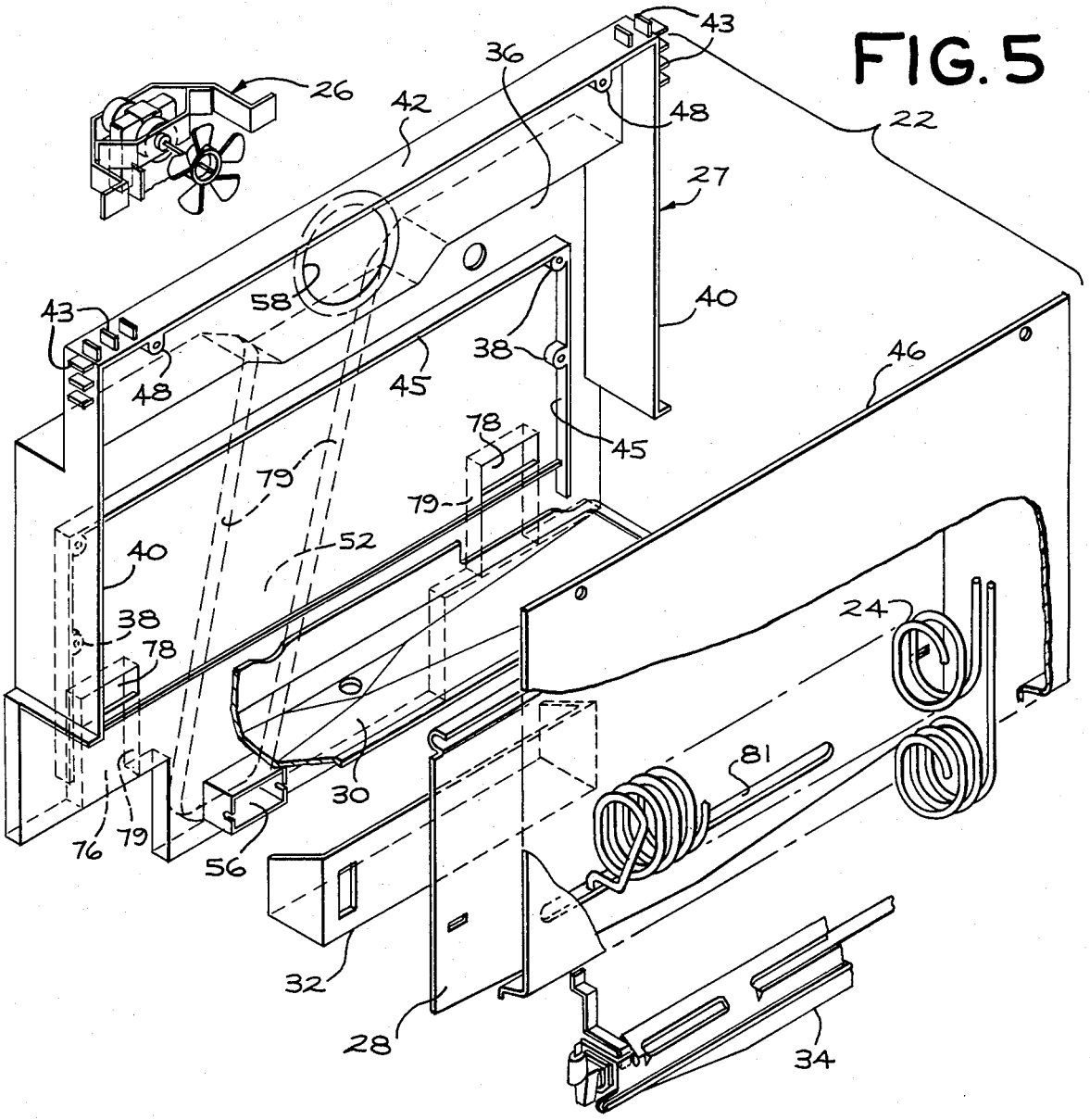
FIG. 5 is an exploded perspective view of the pre-assembled modules of the present invention prior to its installation in the refrigerator cabinet.

By the present invention in order to provide cooling and air circulation for both compartments a pre-assembled module is provided as shown in FIG. 5 and designated generally by numeral 22 which includes an evaporator 24 for cooling and a fan 26 for circulating air between the compartments. More particularly the main components of the module 22 as shown in FIG. 5 include a main support housing 27 on which the fan 26 is arranged, plate 28 on which the evaporator 24 is mounted, a drain pan member 30, the control assembly 32 and the defrost heater 34. The module 22 including the cooling and air circulating components of the refrigerator is designed to be assembled prior to its installation in the cabinet by automation type production equipment wherein robotics are employed in assembling the various parts incorporating the module. To this end, as will be fully explained hereinafter, the main housing 27 (FIG. 5) is formed to include a base wall 36, side walls 40 and a top wall 42 forming the support on which the components making up the module are mounted. Also formed within the housing 27 as will be explained later are the appropriate walls 45, 52 and 79 (FIGS. 2, 4 and 5) forming a plurality of air directing passageways of the air flow system. The width of the housing 27 as defined by the side walls 40 is slightly less than the width of the refrigerator cabinet so as to allow air to flow between walls 40, 42 and the wall 14 in the compartment 20. Projecting from the walls 40, 42 are a plurality of fins 43 which serve to space the module relative to the wall 14 and provide an air flow space therebetween. A plate 28, dimensioned so that its outer side and top edges rest on walls 45, is mounted on bosses 38 projecting from the base wall 36 of housing 27 so as to be spaced therefrom to provide a passageway 44 (FIGS. 1 and 3) whose function will be explained later. The evaporator 24 is mounted on the plate 28 so as to be in heat exchange relationship therewith. The evaporator may be of the type disclosed in U.S. Pat. No. 3,766,976-Gelbard et al assigned to the assignee of the present invention. Also mounted on plate 28 below the evaporator 24 is the defrost heater 34 whose function will be fully explained hereinafter. With the evaporator 24 and heater 34 so positioned on plate 28 a second plate or cover member 46 is then arranged on bosses 48. The cover 46 as shown in FIG. 1 forms a passageway 50 in which air is directed over the evaporator as will be fully explained hereinafter.

Figure 2:
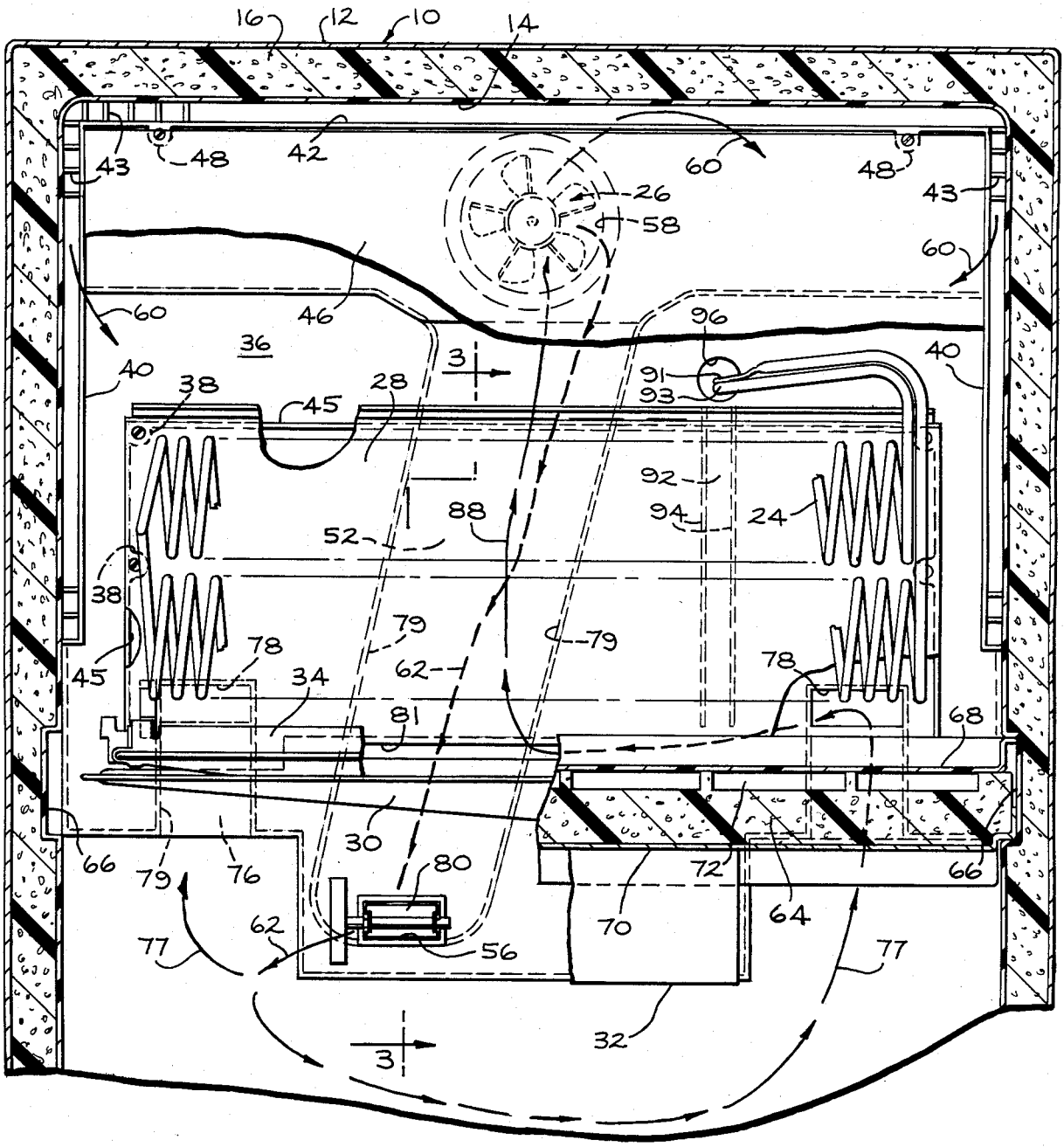
FIG. 2 is a front elevation view, also partly broken away, of a portion of the refrigerator shown in FIG. 1.

In the installed position shown in FIG. 1 air from the module is supplied to compartment 18 by fan 26 through a passageway 52. The passageway 52 is formed by walls 79 which project rearwardly from wall 36 (FIGS. 4 and 5) and extend between the wall 36 of housing 27 and the rear wall portion of wall 14 in compartment 20. The passage 52 extends vertically from a position in the area of fan 26 and terminates at an opening 56 in the lower end of wall 36 which as shown in FIG. 1 is located in compartment 18. Circulation of air between the module 22 and compartments 18 and 20 in the desired proportions is affected by the fan 26 which is positioned in an opening 58 on the wall 36 of main housing 27. As shown in FIGS. 1, 2, 4 and 5 the opening 58 is located adjacent the top of the vertical passages 50 and 52. With the module 22 installed as shown in FIGS. 1 and 2 the fan 26 causes the air to flow upwardly through passage 50 over the cooling evaporator 24 to be directed in part between walls 40, 42 of housing 22 and the inner cabinet wall 14 to the upper compartment 20 as indicated by the arrows 60 and in part through the passageway 52 and opening 56 to the lower compartment 18, as indicated by the arrows 62. The control assembly 32, which may include the control components of the refrigerator, is mounted in the lower portion of wall 36 in a position over the opening 56.

The completed assembly 22 including control assembly 32 is arranged in the upper portion of the cabinet against the rear wall as shown in FIGS. 1 and 2. With the module so arranged a cabinet divider member 64 is then positioned in a pair of receiving tracks or guides 66 (FIG. 2) formed in the side wall portion of the wall 14 of the cabinet to in fact divide the cabinet between the compartments 18 and 20. The dividing member 64 forms the lower wall 68 of compartment 20 and the upper wall 70 of compartment 18. The lower compartment 18 is normally operated at and above freezing temperature, for example between about 35° and 40° F., and the upper compartment 20 is normally operated at a temperature below freezing, for example between 0° and 5° F. The evaporator 24 which is employed for cooling both compartments is normally operated at a temperature of about −5° F. Since the upper compartment must be maintained at a much lower temperature, a much greater proportion of the cool air is directed to that compartment. For example, approximately 90% of the air may be directed to the compartment 20 and approximately 10% to the compartment 18. The cool air is directed to the compartment 20 through the space provided between walls 40, 42 and 14 of the compartment 20 and is returned to the evaporator 24 through a passage 72 formed in divider 64 so as to extend below the bottom wall 68 of the compartment 20, this return flow of air being indicated by the arrows 74. Cooled air is supplied to the compartment 18 by the fan 26 through the passage 52 formed, as explained above, at the back of the refrigerator cabinet. The passage 52 terminates at the opening 56 positioned in the lower end portion of the module 22, which is located in the compartment 18 below divider 64. Air is returned to the evaporator from the compartment 18 through passages 76 as indicated by arrows 77 (FIGS. 3, 4 and 5). The passages 76 are defined by walls 79 formed in the housing 27 and are disposed between wall 36 and the back of the refrigerator at each side thereof. Air from passages 76 (FIG. 3) is directed to passage 44 disposed between wall 36 and plate 28 through an opening 78 in wall 36. From passage 44 air is directed into passage 50 through opening 81 in plate 28 and thence past the evaporator 24. In order to adjust the temperature of the above freezing compartment 18, a manually controlled damper 80 (FIG. 1) is provided in the opening 56 of passage 52. By adjusting the position of the damper 80 the user can cause a greater or lesser amount of air to be directed to the compartment 18.

In the operation of the refrigerators of this type wherein the air cooling the above freezing and below freezing compartments is cooled by causing it to flow over the evaporator located outside of the compartments frost is caused to deposit on the cooling element from the moisture in the air and particularly moisture in the air being returned from the above freezing compartment 18.

In order to maintain the refrigerator at a desirable level of operating efficiency, it is necessary from time to time to remove the frost from the evaporator. This may be accomplished in a number of ways; for example, by providing an electric heating element which is energized at intervals to melt the frost. The heating element 34 for this purpose as shown in the drawings extends transversely of the passage 50 near the bottom thereof and below the evaporator 24. It is impossible, of course, to cause all of the heat from the heating element 34 to be confined totally to melting the frost on the evaporator. Perhaps as much as 75% of the heat in a conventional refrigerator may be directed to portions of the refrigerator other than the frost on the evaporator, thereby undesirably raising the temperature of the frozen foods and the fresh foods stored therein and reducing the efficiency of the refrigerator. It is, therefore, desirable that the length of the time between defrosting operations be extended as long as reasonably possible and that the heating element be operated for as short a time as possible in accomplishing the defrosting operation.

For this purpose the module 22 as mentioned above is constructed to provide for the vertical passageway 44 to be formed adjacent to the plate 28 and on opposite sides of the plate from that on which the evaporator 24 is mounted. Although the passage 44 may be formed in any manner between the plate 28 and the wall 36, it is conveniently and economically formed as shown in FIGS. 2 and 4 by providing wall portions 84 on wall 36 which extend forwardly into engagement with the outer top and side edge portions of plate 28. The passage 44 formed by walls 45 and plate 28, as can best be visualized from FIGS. 1–4, extends across the substantially entire width of the rear wall of the housing 27. As shown by the arrows 86 (FIG. 3) this return air is caused by inertia to flow upwardly a substantial distance in the vertical passage 44 in contact with the plate 28 which is essentially at the same low temperature, namely −5° F., as the evaporator 24. The opening 81 extending transversely at the bottom of the plate 28 directs air from the passage 44 to the passage 50 and then over the cooling evaporator 24 as shown by the arrows 88. Thus, the air returning from the above freezing compartment 18 is caused to flow upwardly in the vertical passage 44 over a portion of the plate 28 and thence downwardly over this plate 28 to the opening 81 from which it passes into the passage 50 and thence over the evaporator 24. Even though the inertia of the air entering passage 44 may not be enough to carry the air in contact with the entire surface of plate 28, frost will still tend to form over this entire surface because of frost migration to colder surfaces. If, for example, frost should initially form on the bottom portion of plate 28 the insulating effect of the frost will tend to make the bottom area warmer than the upper unfrosted area of the plate and collected frost will therefore migrate to the upper colder area to produce a relatively even coating of frost on the plate 28.

The above freezing compartment 18 is used to store fresh foods and in normal usage there is much more frequent occasion for access to this compartment than to compartment 20 which is maintained at a below freezing temperature for storage of frozen foods. Particularly in warm humid weather as the door 90 providing access to compartment 18 is opened air with substantial amount of moisture therein is admitted to the compartment 18. Such moisture, of course, has a tendency to deposit as frost when it strikes the evaporator. By causing the moisture laden air returning from the compartment 18 to pass first through passage 44 and contact with the cold surface of plate 28 the frost preferentially deposits on this plate.

Provision is also provided in the module 22 for accommodating the capillary tube 91 and suction line 93 connected to the inlet and outlet of the evaporator respectively so that they do not interfere with the placement of the module relative to the rear wall of the cabinet. To this end, a channel 92 is formed on the rear surface of wall 36 by a pair of walls 94. The channel 92 alignes with an opening 96 on wall 36 through which the tube 91 and line 93 exit the passage 50. In the assembled module 22 the tube 91 and line 93 are positioned in the channel 92 and are then bent rearwardly at a position near the lower portion of the module 22. As the module 22 is inserted in the cabinet the rearwardly directed portion of the tube 91 and line 93 are inserted through an opening 98 in the rear wall of the cabinet. The ends of the tube 91 and line 93 so positioned outside of the cabinet may then be conveniently connected to the refrigeration system.

It should be apparent to those skilled in the art that the embodiment described heretofore is considered to be the presently preferred form of this invention. In accordance with the Patent Statues, changes may be made in the disclosed apparatus and the manner in which it is used without actually departing from the true spirit and scope of this invention.

What is claimed is:

1. A self-contained pre-assembled air circulating and cooling module adapted to be arranged in a refrigerator cabinet including guide means dimensioned for receiving a partition means dividing said refrigerator cabinet between a first food storage compartment to be maintained at a temperature above freezing and a second food storage compartment to be maintained at a below freezing temperature, the method of assembling and arranging said pre-assembled air circulating and cooling module in said cabinet comprising the steps of:

providing a main support frame dimensioned to extend substantially the full width of said cabinet in said second food storage compartment;

mounting a plate having an evaporator secured on one side thereof in spaced relationship to said main support frame to define a first passageway therebetween;

positioning a cover portion on said support frame in spaced relationship to said plate defining a second passageway including said evaporator;

arranging air moving means in said module for moving air through said passageways;

inserting said module in said cabinet in spaced relationship to the rear wall of said cabinet so that a third passageway is arranged between said support frame and said cabinet wall; and arranging said partition means in said cabinet guide means to thereby divide said cabinet between said first and second food storage compartments; whereby said air moving means directs air from said first compartment to said first passageway and thereafter to said second passageway and then through said third passageway back to said first compartment, and for directing air from said second compartment to said second passageway and thereafter back to said second compartment.

2. The invention recited in claim 1 wherein a defrost heater is mounted on said plate at a location below said evaporator and a drain pan including drain means is mounted on said main support frame below said first and second passageway for directing moisture therefrom to a location outside said refrigerator cabinet.

3. A self-contained pre-assembled air circulating and cooling module adapted to be arranged in a refrigerator cabinet including means dividing said refrigerator cabinet between a first food storage compartment to be maintained at a temperature above freezing and a second food storage compartment to be maintained at a below freezing temperature, said pre-assembled air circulating and cooling module comprising:

a main support frame including a base wall and forwardly projecting outer walls formed along the sides and upper edges of said base wall dimensioned to extend substantially the full width of said cabinet in said second food storage compartment;

inner wall portions arranged inwardly of said outer walls projecting forwardly from said base wall of said support frame a distance less than said outer walls;

a plate having an evaporator secured on one side thereof being mounted on the edge portions of said inner wall portions on said main support frame with the other side of said plate forming a first passageway between said base wall and said plate;

a defrost heater mounted on said plate below said evaporator;

a cover portion arranged on the free ends of said forwardly projecting walls of said support frame defining a second passageway including said evaporator between said plate and said cover portion;

a drain pan including drain means mounted on said base wall below said first and second passageways for directing moisture therefrom to a location outside said refrigerator cabinet;

wall formed on said base wall of said support frame extending rearwardly therefrom, defining a third passageway arranged between said support frame and said cabinet;

means for directing air from said first compartment to said first passageway and thereafter to said second passageway and then through said third passageway back to said first compartment, and for directing air from said second compartment to said second passageway and thereafter back to said second compartment; and means forming a refrigerant tube passageway formed on the rearward side of said base wall of said support frame for receiving refrigerant tubing connected to said evaporator.

* * * * *